US005460874A

United States Patent [19]

Rao

[11] Patent Number: 5,460,874

[45] Date of Patent: Oct. 24, 1995

[54] WATER-BASED COATING COMPOSITIONS FOR IMAGING APPLICATIONS

[75] Inventor: S. Prabhakara Rao, Maplewood, Minn.

[73] Assignee: Minnesota Mining and Manufacturing Company, St. Paul, Minn.

[21] Appl. No.: 316,556

[22] Filed: Sep. 30, 1994

[51] Int. Cl.[6] ..... B41M 5/26

[52] U.S. Cl. ..... 428/327; 428/195; 428/206; 428/323; 428/334; 428/335; 428/336; 428/337; 428/520; 428/522; 428/913; 428/914

[58] Field of Search ..... 8/471; 428/195, 428/913, 914, 206, 323, 327, 334–337, 520, 522; 503/227

[56] References Cited

U.S. PATENT DOCUMENTS

| | | | |
|---|---|---|---|
| 4,211,684 | 7/1980 | Koyama et al. | 260/29.6 |
| 4,217,395 | 8/1980 | Kuan et al. | 428/494 |
| 4,331,738 | 5/1982 | Kuan | 428/494 |
| 4,673,626 | 6/1987 | Takeda et al. | 430/14 |
| 4,683,260 | 7/1987 | Wickert | 524/512 |
| 4,686,549 | 8/1987 | Williams et al. | 503/227 |
| 4,749,616 | 6/1988 | Liu et al. | 428/331 |
| 4,839,224 | 6/1989 | Chou et al. | 428/323 |
| 4,847,237 | 7/1989 | Vanderzanden | 503/227 |
| 4,847,238 | 7/1989 | Jongewaard et al. | 503/227 |
| 5,200,254 | 4/1993 | Henry et al. | 428/195 |
| 5,217,767 | 6/1993 | Gutman et al. | 428/35.3 |
| 5,238,736 | 8/1993 | Tseng et al. | 428/327 |
| 5,284,815 | 2/1994 | Uytterhoeven et al. | 503/227 |
| 5,310,595 | 5/1994 | Ali et al. | 428/206 |

FOREIGN PATENT DOCUMENTS

| | | |
|---|---|---|
| 0347760 | 12/1989 | European Pat. Off. . |
| 58-080358A | 5/1983 | Japan . |
| 02173071A | 7/1990 | Japan . |
| 04300393A | 10/1992 | Japan . |

OTHER PUBLICATIONS

J. P. Greenstein et al., "Carbodiimide Method" in *Chemistry of the Amino Acids*, vol. 2; John Wiley and Sons: New York; pp. 1016–1024 (1961).

G. R. Joppien et al., "The Structure of Adsorbed Polymer Layers on Pigment Surfaces as Related to Dispersion Stability" in *Organic Coatings, Science and Technology*, vol. 6; G. D. Parfitt et al., Eds.; Marcel Dekker, Inc.: New York; pp. 423–454 (1984).

E. Killmann et al., "Fraction of H–bonded segments of N–ethylpyrrolidone, oligomeric and polymeric vinylpyrrolidone adsorbed from $CHCl_3$ on silica measured by IR spectrometry", *Colloid Polymer Sci.*, 263, 372–380 (1985).

E. Killmann et al., "Microcalorimetric studies of the adsorption of N–ethylpyrrolidone, oligomeric and polymeric vinylpyrrolidone from $CHCl_3$ on silica", *Colloid Polymer Sci.*, 263, 381–387 (1985).

J. S. Michelman et al., "Wax emulsions in aqueous polymeric coatings: contributions and mechanism", *Tappi Journal*, 72, 159–163 (Apr. 1989).

H. Sakai, "Effects of anti–blocking agent and anchor coating agent on the film properties of high barrier Saran latex", *Chem Abs.*, 117, Abstract No. 172686d, p. 44 (1992).

P. A. Williams et al., "Adsorption of an Amphoteric Polymer on Silica and Its Effect on Dispersion Stability", *J. Coll. Interface Sci.*, 102, 548–556 (Dec. 1984).

*Primary Examiner*—B. Hamilton Hess

*Attorney, Agent, or Firm*—Schwegman, Lundberg & Woessner

[57] ABSTRACT

The receptor sheet of the present invention includes a substrate on which is coated an image-receiving layer formed from a water-based coating composition. The water-based coating composition includes a major amount of a latex polymer having a Tg of no greater than about 30° C.; a minor amount of a water-soluble low molecular weight compound or salt having reactive functional groups; and a minor amount of a water-soluble carbodiimide.

25 Claims, No Drawings

WATER-BASED COATING COMPOSITIONS FOR IMAGING APPLICATIONS

FIELD OF THE INVENTION

The present invention relates to water-based coating compositions for imaging applications such as transparent recording materials suitable for use in thermal printers, particularly thermal mass transfer printers, as well as electrographic and xerographic copiers. More specifically, it relates to water-based coatings for image receptor sheets that can be used as transparencies for overhead projectors. The coatings include a low Tg latex formulation having a low tack or nontacky surface.

BACKGROUND OF THE INVENTION

Many different types of transparent image recording sheets, or "transparencies" as they are called in the industry, are known in the art. Transparencies can be made by different printing and imaging methods, such as thermal transfer printing and ink jet printing as well as color photocopying and plain paper copying, e.g., electrography and xerography. All of these transparencies are suitable for use with overhead projectors.

In copying procedures, the formation and development of xerographic images uses a toner composition containing resin particles. Toners are generally applied to a latent image generated on a photoconductive member. The image is then transferred to a suitable substrate, such as a transparent image receptor, and affixed thereon, by the application of heat, pressure, or a combination thereof. These transparent image receptors generally include a polymeric substrate, such as polyethylene terephthalate, and have an image-receiving layer coated thereon for better toner adhesion.

In thermal transfer imaging or printing, an image is formed on a receptor sheet, e.g., transparency, when a donor sheet or ribbon, having a colorant (e.g., dye or pigment) layer thereon, is brought into intimate contact with the receptor sheet and heated with a localized heat source, such as a laser or a thermal print head. The heat source directly contacts the backside of the donor sheet. A thermal print head contains small, electrically heated elements that can be selectively heated, thereby transferring colorant, either alone or in association with carrier materials, from the donor sheet to the receptor sheet in an image-wise manner. This imaging process can involve either mass transfer of colorant in a binder or state-altered transformation of a dye, as by melt transfer, diffusion, or sublimation of the colorant, for example. In a mass transfer process, the colorant, e.g., dye or pigment, is dispersed within a binder, as in a toner, and both the colorant and its binder are transferred from a donor sheet to a receptor sheet. In a dye transfer process, the colorant (the "dye" present on the donor with or without a binder) is transferred without binder by melting, melt-vaporization, propulsive ablation, sublimation, or vaporization, for example, to a receptor sheet where the colorant adheres to, or diffuses into, the image-receiving layer.

Such thermal transfer systems generally require the use of receptor sheets with certain specific requirements. For example, the receptor sheet should be designed to effectively receive an image from a donor sheet and to hold the image and yield a desired print with generally high optical image density, brightness, and stability. Preferably, it should also be generally scratch resistant and have little or no tack or static buildup, particularly if the receptor sheet is a transparency. In a typical receptor sheet, an image-receiving layer is coated on a substrate, preferably a flexible substrate that is formed from a film-forming material, such as paper, polymeric film, and the like, although for transparencies, the substrate is a transparent polymeric film. The image-receiving layer typically includes a polymeric resin, e.g., a thermoplastic film-forming resin, that is compatible with colorants and adheres well to the substrate, either directly or through the use of an intermediate adhesive layer.

Although there are a host of receptor sheets available for use in thermal mass printing and electrographic or xerographic copying, there remains a need for new receptor sheets bearing image-receiving layers that enable the formation of generally high quality black and white or color images, with low tack, good feedability, good scratch resistance, low haze, and good adhesion to the substrate. Furthermore, there is a need for an image-receiving layer that can be coated out of an aqueous composition, i.e., a latex, as most image-receiving layers are coated out of organic solvent formulations. Organic solvent formulations are undesirable at least because such formulations use expensive, toxic, volatile, and often flammable organic solvents, which typically must be captured upon drying to prevent air pollution and health and safety problems.

Water-based coating compositions for various nonimaging applications are known, e.g., wood and rubber coatings; however, there are few water-based coating compositions known and used in thermal transfer systems. Many water-based coating compositions include "soft" latex polymers, i.e., polymers having a low glass transition temperature (i.e., a "Tg" of about 30° C. or lower). Such compositions, however, are generally too tacky for use in the image-receiving layer on receptor sheets, particularly transparencies. That is, polymeric substrates coated with an image-receiving layer containing a soft polymer typically stick together and thus cannot be fed easily into a printer.

A typical solution to this problem is to blend a high Tg latex, i.e., a polymer having a Tg of about 45° C. or higher, with the low Tg latex. Such a blending of latexes of low and high Tg polymers, or designing latex polymers that include segments of widely differing glass transition temperatures in different proportions, provides coatings of varying degrees of hardness and softness. This approach can result in certain desirable properties, e.g., low tack, high hardness, etc. For example, carboxylate latexes of butadiene/itaconic acid/methacrylic acid/styrene copolymers (Tg of −10° C. to −16° C.) blended with a latex of ethyl acrylate acrylamide and methyl methacrylate in equal amounts (Tg>45° C.) produces nontacky coatings. This method of mixing low and high Tg polymers can also result in undesirable properties, however, particularly if used in coating compositions for imaging applications. For example, if the low and high Tg polymers are incompatible, a nonuniform microstructure and haze can result, which can lead to poor quality images and discreet tacky regions on the surface of the coating.

Other methods of decreasing the tackiness of water-based coating compositions include the use of additives such as N-dodecylsulfosuccinamate, silicon dioxide, adipoyl dihydrazide, polyvinyl alcohol, and a blend of sodium linoleate, $CaCO_3$, and silica. Basic materials such as adipoyl dihydrazide, however, are limited to use in cationic latexes, which are generally few in number. Molecules containing hydrocarbon chains such as N-dodecyl sulfosuccinamate can cause compatibility problems with acrylic materials. The use of calcium carbonate materials may not be suitable for sufficiently transparent coatings.

Thus, what is needed is an image-receiving layer that can be coated out of an aqueous coating composition to produce a generally nonblocking, i.e., low tack or nontacky, receptor sheet, particularly a transparency, imageable with generally good image quality and capable of withstanding the printing process with little or no scratching. The resultant image-receiving layer should exhibit generally good adhesion to the surface of a substrate, to the donor surface during imaging, and also to colorants, e.g., toners, transferred during the imaging process.

SUMMARY OF THE INVENTION

The present invention provides an image-receiving layer that can be coated out of an aqueous, i.e., water-based, coating composition to produce a generally nonblocking, i.e., low tack or nontacky, receptor sheet, preferably a transparency, imageable with generally good image quality and capable of withstanding the printing process with little or no scratching. The image-receiving layer of the present invention has generally good adhesion to the surface of a substrate, to the donor surface during imaging, and also to the transferred colorants. Preferably, the receptor sheets of the present invention possess generally desirable feed and antistatic properties, and have a generally low haze value (preferably less than about 5% haze). More preferably, the image-receiving layer once dried is generally insoluble in water and common polar solvents like alcohols and generally soluble in common ketones. These characteristics provide receptor sheets that can be used effectively in color or black and white applications, in both thermal mass transfer printers as well as electrophotographic and xerographic copier machines, e.g., plain paper copiers.

The receptor sheet of the present invention includes a substrate, preferably a flexible substrate, more preferably a transparent substrate, and most preferably a flexible transparent substrate, on which is coated an image-receiving layer formed from a water-based coating composition comprising:

(a) a major amount of a latex polymer having a Tg of no greater than about 30° C.;

(b) a minor amount of a water-soluble low molecular weight compound or salt having reactive functional groups (preferably hydroxyl, carboxyl, amino, amido groups, or combinations thereof); and (c) a minor amount of a water-soluble carbodiimide.

This water-based coating composition is coated on at least one side of the substrate and dried to form an image-receiving layer for improved printability. Preferably, the water-based coating composition contains about 80–95 wt-% latex polymer, about 0.2–2 wt-% water-soluble low molecular weight compound or salt containing reactive functional groups, and about 0.1–1 wt-% water-soluble carbodiimide. As used herein, the weight percentages are based on the total weight of the solids content of the water-based coating composition (i.e., solids:solids), unless otherwise specified.

DETAILED DESCRIPTION OF THE INVENTION

Transparencies for overhead production of images are generally surface-treated transparent polymeric films. One of the most common methods of surface treatment is the application of a coating on the printing surface of the film. This invention provides water-based coating compositions for coating on transparent polymeric films, as well as other receptor sheet substrates, to form an image-receiving layer containing a "soft" or low Tg (i.e., Tg no greater than about 30° C.) latex polymer and other components that render this soft Tg polymer sufficiently nontacky. Thus, the coated sheet, i.e., receptor sheet, can be unwound from the coating equipment without substantial blistering. Furthermore, the coated sheets can be stacked on top of each other generally without sticking together.

The coating compositions for the image-receiving layer, i.e., image-receptive layer or imaging layer, of the present invention include a generally tacky, aqueous suspension of a latex polymer that has a glass transition temperature of no greater than about 30° C., preferably no greater than about 25° C., and more preferably no greater than about 0° C. The latex polymer is in the form of particles and is generally hydrophobic with some hydrophilic characteristics to enhance colloidal stability of the particles over that provided by electrostatic charges. Such particles of latex polymers often have a shell of a generally water-soluble polymer containing polar, i.e., hydrophilic, groups adsorbed onto the surface of the particles. Additionally or alternatively, such particles of latex polymers have polar monomeric units within the latex polymer backbone, in which case the polar groups are typically on the surface of the particles. Whichever of these mechanisms results in particle formation, such latex polymers can be referred to as particle-forming latex polymers.

Preferably, the particle-forming latex polymers useful in the present invention are generally hydrophobic and contain less than about 5 wt-% polar groups, e.g., hydroxyl, carboxyl, or amino groups, based on the total weight of the polymer. Although it is not intended to be limiting, these groups can be contained either within an outer shell of hydrophilic polymer, within monomeric units of the polymer itself, or both, as discussed above. More preferably, latex polymers useful in the present invention contain about 1–5 wt-%, and most preferably about 2–5 wt-% polar groups. If a nonionic surfactant is used in combination with the latex polymer, useful latex polymers are those that contain about 2–5 wt-% polar groups. A combination of a nonionic surfactant and an ionic surfactant, however, enable the use of latex polymers containing less than about 2 wt-% polar groups.

Preferably, the latex polymer is prepared from ethylenically unsaturated monomers; however, generally any low Tg monomers, such as butyl acrylate, for example, that form a particle-forming low Tg latex polymer can be used. More preferably, the latex polymer is a copolymer of ethylene and monomers selected from the group consisting of vinyl acetate, vinyl chloride, and acrylic monomers that contain —OH, —COOH, $—CONH_2$, $—NH_2$, $—COOCH_2CH_2OH$, $—SO_3H$, $—p—C_6H_4—SO_3H$, —pyridyl, $—CONR_2$, $—NR_2$, or $—NR_4^+$ (wherein R is a lower alkyl group, i.e., containing 1–3 carbon atoms) functionality, such as acrylic acid monomers, or mixtures thereof. If acrylic monomers are present in the polymer, preferably the latex polymer contains about 2–10 wt-% acrylic monomeric units, based on the weight of the polymer. Also, the functional groups present in the acrylic monomers are preferably —OH, —COOH, $—CONH_2$, $—NH_2$, $—SO_3H$, $—NR_2$, or $—NR_4^+$ (wherein R is a lower alkyl group, i.e., containing 1–3 carbon atoms)

As used herein, "copolymer" refers to polymers containing more than one type of monomeric unit. This includes, for example, terpolymers, tetrapolymers, etc. Most preferably, the latex polymer used in the composition of the present invention is a terpolymer prepared from ethylene, vinyl acetate, and vinyl chloride monomers. Preferably, this terpolymer has surface hydroxyl groups, which arise from the hydrolysis of vinyl acetate.

Examples of suitable low Tg latexes include ethylene-vinyl acetate copolymers and terpolymers, such as those available under the tradename AIRFLEX [e.g., AIRFLEX 420 (Tg −20° C., vinyl acetate/ethylene copolymer), AIRFLEX 421 (Tg 0° C., vinyl acetate/ethylene copolymer, self-crosslinking), AIRFLEX 426 (Tg 0° C., vinyl acetate/ethylene copolymer containing carboxyl groups), and AIRFLEX 430 (Tg 0° C., vinyl chloride/vinyl acetate/ethylene terpolymer) from Air Products and Chemicals Inc. (Lehigh Valley, Pa.)], and Allied Signal's A–C 5180 (vinyl acetate/ethylene copolymer with acid number of 180, available from Michelman Inc., Cincinnati, Ohio); and ethylene/acrylic acid copolymers, such as Michelman Emulsion 34040 (an aqueous dispersion of Allied Signal's ethylene/acrylic acid copolymer 5120) available from Michelman Inc. (Cincinnati, Ohio). Most preferably, the low Tg latexes suitable for use in the compositions and image-receiving layers of the present invention are vinyl chloride/vinyl acetate/ethylene terpolymers, such as AIRFLEX 430 available from Air Products.

The low Tg latex is used in the coating compositions of the present invention in a major amount, i.e., greater than about 50 wt-%, preferably in an amount of about 80–95 wt-%, based on the total weight of the solids content of the coating composition, which is generally equivalent to the amount of polymer in the dried image-receiving layer. A coating of an ethylene/vinyl acetate/vinyl chloride latex, on a polyester film, either primed or unprimed with poly(vinylidene chloride), produces a transparent, moderately tacky surface. However, a polyester film roll with such a coating becomes a "block" in less than about 24 hours under a pressure of about 0.5–1 psi (pounds per square inch). Unwinding of such a roll of film can be very difficult and even impossible without significant blistering of the coating.

This blockiness or blocking between sheets, i.e., tack, can be reduced by the addition of a minor amount, i.e., less than about 50 wt-%, of a water-soluble, low molecular weight, organic or inorganic compound or salt that contains reactive functional groups. In this context, "low molecular weight" means compounds or salts having a molecular weight of less than about 1000 grams/mole, which includes the weight of the counterion(s) and molecules of hydration for the salts. "Water-soluble" means compounds or salts that are soluble in water at least to the extent of about 10% (weight of solute/weight of water). Preferably, such compounds are greater than about 20% soluble in water and are crystalline solids at room temperature, i.e., 20°–30° C. "Reactive functional groups" are moieties that are capable of interacting with the other components of the composition, such as the latex polymer or the carbodiimide, for example. This interaction can be through covalent bonding, ionic bonding, electrostatic interaction, hydrogen bonding, van der Waals forces, etc. The functional groups are preferably chosen such that they interact with the low Tg latex polymer. Such reactive functional groups include, for example, groups such as hydroxyl groups, carboxyl groups, amido groups, amino groups, and combinations thereof (such as in zwitterions). If a colorless receptor sheet is desired, the water-soluble low molecular weight compound or salt is generally colorless as well.

Examples of suitable water-soluble low molecular weight compounds or salts containing reactive functional groups include, but are not limited to: amino acids such as glycine, lysine, glutamic acid; other amide-containing molecules or salts such as urea; hydroxyl-containing molecules such as pentaerythritol and methyl glucamine; carboxyl-containing molecules such as sodium potassium tartrate, potassium hydrogen tartrate, γ-hydroxybutyric acid, and ethylenediaminetetraacetic acid; and salts such as ammonium sulfamate and sodium dodecyl sulfate. A particularly preferred water-soluble low molecular weight compound is ethylenediaminetetraacetic acid (EDTA) available as a disodium salt dihydrate from Aldrich Chemical Company (Milwaukee, Wis.), at least because it contributes to the formation of a nontacky image-receiving layer with good print quality.

A water-soluble low molecular weight compound is used in the coating compositions of the present invention in an amount effective to reduce the tackiness of the dried coating. Preferably, it is present in the coating compositions of the present invention in an amount of about 0.2–2 wt-%, more preferably about 0.5–1 wt-%, based on the total weight of the solids content of the coating composition.

The effect of reducing the tackiness of the latex coating using small molecules having reactive functional groups is enhanced by the addition of a minor amount of a water-soluble carbodiimide. In this context, "water soluble" means that the carbodiimide is greater than about 10% (weight carbodiimide/weight water) soluble in water. A particularly preferred water-soluble carbodiimide is 3-ethyl-3-(dimethylamino)propyl carbodiimide hydrochloride salt available from JBL Scientific Inc. (San Louis Obispo, Calif.).

A water-soluble carbodiimide is used in the coating compositions of the present invention in an amount effective to facilitate crosslinking during the drying process of the coating between carboxyl groups, carboxyl and amino groups, and/or carboxyl and hydroxyl groups, for example. Preferably, a water-soluble carbodiimide is used in the coating compositions of the present invention in an amount of about 0.1–1 wt-%, more preferably about 0.1–0.5 wt-%, and most preferably about 0.2–0.5 wt-%, based on the total weight of the solids content of the coating composition.

In certain preferred embodiments, additional advantage is gained by the use of a water-soluble hydroxyl-containing polymer. In this context, "water-soluble" means that the hydroxyl-containing polymer is greater than about 1% soluble in water. Preferably, the water-soluble hydroxyl-containing polymer has a weight average molecular weight of greater than about 10,000, and more preferably greater than about 15,000. Generally, the hydroxyl-containing polymer has a weight average molecular weight of no greater than about 115,000, for advantageous water solubility. Examples of suitable water-soluble hydroxyl-containing polymers include, but are not limited to: polyacrylic acid; polyacrylamide and substituted polyacrylamides; polyvinyl alcohols; polymethacrylic acid; poly(acrylamidomethylpropane)sulfonic acid; and cellulose derivatives such as hydroxyethyl cellulose, hydroxypropyl cellulose, guar gum, xanthan gum, and amylose. Preferably, the water-soluble hydroxyl-containing polymer is a water-soluble polyvinyl alcohol. Commercially available water-soluble polyvinyl alcohols are available from Aldrich Chemical Company and Air Products Company (Allentown, Pa.).

A water-soluble hydroxyl-containing polymer is used in the coating compositions of the present invention in an amount effective to enhance colorant adhesion. Preferably, it is used in an amount of about 0.1–3 wt-%, more preferably about 0.2–2 wt- %, and most preferably about 0.5–1 wt- %, based on the total weight of the solids content in the coating composition.

Although the inventor does not wish to be held to any particular theory, it is believed that the water-soluble low molecular weight compounds are sufficiently incompatible with the low Tg, generally hydrophobic, latex polymer that they "bloom" from the latex, i.e., migrate to the surface of the latex, through voids in the latex particle packing. It is further believed that they are sufficiently "anchored" to the latex polymer, the water-soluble carbodiimide, and/or the hydroxyl-containing polymer by the reactive functional groups contained therein such that blooming is controlled. Thus, there is minimal phase separation, although the blooming that does occur appears to provide a generally hardened crystalline surface, i.e., a generally nontacky surface, on the "soft" latex.

In particularly preferred embodiments, particulate material, i.e., particles or beads, can also be present in the coating compositions for the image-receiving layer of the present invention. Such particulate material can be inorganic or organic particles, i.e., beads, that do not easily fuse during drying of the image-receiving layer and are compatible with the components of the coating composition, particularly the latex polymer. As used in this context, "compatible" means that the antiblocking agent does not produce a significantly hazy image-receiving layer. That is, there is a match in the refractive index between the polymer matrix and the particles such that little or no haze forms. The particulate material provides a rough surface that enhances adhesion, for example, with the colorant upon transfer. Certain of the particles or beads also decrease the coefficient of friction, and thus lower the tendency of the coating to adhere to the underside of a second receptor sheet. This improves feeding by reducing multiple feeding tendencies.

Preferred particulate materials, i.e., particles or beads, useful in the present invention include organic polymeric particles made of a high Tg latex polymer, i.e., having a Tg of at least about 45° C., preferably at least about 60° C. Preferred particulate material also has an average particle size of less than about 10 μm. More preferably, the average particle size is about 0.5–10 μm, and most preferably about 4–8 μm. For particle sizes lower than about 0.5 μm, more particles are generally needed to produce effective coefficient of friction reduction. However, the addition of more particles tends to also produce more haze, which is undesirable for use with an overhead projector. For particles greater than about 10 μm, thicker coatings are typically required to anchor the particles firmly to the substrate, which can complicate the drying process and increase coating costs. Larger particles can also adversely affect the print quality of some print patterns.

Suitable particulate material can include reactive particulate material, nonreactive particulate material, or a combination thereof. As used herein, "reactive" particulate material contains functional groups capable of interacting with the other components of the composition, whereas "nonreactive" particulate material does not. Nonreactive particulate material is preferred at least because they provide significant antiblocking properties to the receptor sheets of the present invention. Thus, nonreactive particulate materials is referred to herein as primary antiblocking particulate material. Reactive particulate material provides surface roughness and typically adheres better to the receptor sheets than nonreactive particulate material. Reactive particulate material can also enhance the antiblocking properties of the receptor sheets when used in combination with nonreactive particulate material. Thus, reactive particulate material are referred to herein as secondary antiblocking particulate material. If particulate material is used, the primary antiblocking particulate material is preferred, with a combination of the primary and secondary antiblocking particulate material being more preferred.

Examples of suitable nonreactive particulate material includes, but are not limited to: polymethylmethacrylate (PMMA beads); polyethylene beads; styrene/acrylic beads, such as the hollow sphere "pigment" beads available under the tradename RHOPAQUE HP-91 from Rohm & Haas; and beads comprising diol di(meth)acrylate homopolymers or copolymers of these diol di(meth)acrylates with long chain fatty alcohol esters of (meth)acrylic acid and/or ethylenically unsaturated comonomers, such as SMA-HDDA (stearyl methacrylate/hexanediol diacrylate) crosslinked beads, as described in U.S. Pat. No. 5,238,736 (Tseng et al.) and U.S. Pat. No. 5,310,595 (Ali et al.). Also useful nonreactive particulate material includes inorganic particles including silica particles such as SIPERNAT particles available from DeGussa Corporation (Arlington Heights, Ill.), SYLOID particles available from Grace GmbH (Ridgefield Park, N.J.), GASIL 23F particles available from Crosfield Chemicals (Baltimore, Md.), and the like.

Examples of suitable reactive particulate material includes, but are not limited to: substituted PMMA beads (e.g., substituted with carboxyl groups) such as those available under the tradenames RHOPLEX B-88 latex, ACRYLOID ASE-95NP (alkali soluble or swellable beads), and ACRYSOL ASE-60 all from Rohm & Haas (Charlotte, N.C.); carboxylated polystyrene beads; azlactone beads; and urea-formaldehyde particles, such as PERGOPAK M2 particles available from Ciba-Geigy Corporation (Hawthorne, N.Y.).

In particularly preferred embodiments, stearyl methacrylate/hexanediol diacrylate ("SMA-HDDA") crosslinked beads are used as the nonreactive particulate material either alone or in combination with poly(methylmethacrylate) particles with surface carboxyl groups ("PMMA-COOH"). Most preferably, the particles contain a hydrocarbon surface to reduce friction, such as stearyl methacrylate hardened by crosslinkers.

A particulate material, or combination of particulate materials can be used in the coating compositions of the present invention in an amount effective to facilitate slip between adjacent coated sheets. The primary antiblocking material is preferably present in an amount of about 0.05–5 wt-%, and more preferably about 0.05–1 wt-%, based on the total weight of the solids content of the coating composition. The secondary antiblocking material is preferably present in an amount of about 0.05–10 wt-%, more preferably about 0.05–6 wt-%, and most preferably about 3–6 wt-%, based on the total weight of the solids content of the coating composition.

Other optional additives that can be used in the aqueous coating compositions of the present invention include, for example, surfactants, antistatic agents, slip agents, crosslinking agents such as CYMEL glycoluril-based crosslinking agents available from Cyanamide (West Patterson, N.J.), and phase transfer catalysts such as tetrabutylammonium bromide. Such additives are used in an amount effective to produce a desired result. It should be understood that they can be used in various combinations.

A surfactant can be used to achieve a better blend of the components in the formulation. Block polymer surfactants can act as compatibilizers between dissimilar polymeric units. Surfactants can also enhance polymer adhesion. Suitable surfactants can be any of a variety of commercially available materials that can be used in aqueous media. They can be ionic or nonionic, and can be used in various combinations. Suitable surfactants include, but are not limited to, polyethylene oxide (also known as polyethylene glycol, or PEG) surfactants, such as SILWET L-7614 (a poly(dimethylsiloxane)-g-polyethylene oxide with hydroxy terminal groups) available from Union Carbide Corporation (South Charleston, W.V.); and polyethylene oxides, which are derivatized at both ends by long hydrocarbon chains, such as MAPEG 400DL (a PEG 400 dilaurate) or MAPEG 400DO (a PEG 400 dioleate) supplied by PPG Mazer Chemicals (Gurnee, Ill.). In preferred embodiments, a surfactant is used in an amount up to about 5% of the total weight of the solids content of the coating composition. In particularly preferred embodiments, it is used in an amount of about 0.1–1 wt-%, and more preferably in an amount of about 0.1–0.5 wt-%, based on the total weight of the solids content of the coating composition.

A slip agent can be used to enhance the reduction in tack of the receptor sheets of the present invention. Suitable slip agents can be any of a variety of commercially available materials that can be used in aqueous media. These include, but are not limited to, emulsions of carnauba wax commercially available under the tradename MICHEM Lube 160 from Michelman Inc., and dispersions of silicone polymers commercially available under the tradename Q2-3238 (an ultra high molecular weight silicone polymer) from Dow Corning (Midland, Mich.). In preferred embodiments, a slip agent is used in an amount up to about 3% of the total weight of the solids content of the coating composition. In particularly preferred embodiments, it is used in an amount of about 1–3 wt-%, and more preferably in an amount of about 1–2 wt-%, based on the total weight of the solids content of the coating composition. It should be understood that combinations of slip agents can also be used.

An antistatic agent can also be incorporated into the image-receiving layer of the present invention to improve the antistatic properties of the layer, i.e., to reduce static charge buildup. Useful antistatic agents include perfluoroalkylsulfonamidopolyether derivatives, quaternary ammonium salts, and polyether diamines. Also useful are stearamidopropyldimethyl β-hydroxyethylammonium nitrate and N,N-bis(2-hydroxyethyl)N-(3'dodecyl-2"-hydroxypropyl-)methylammonium nitrate, both of which are available from American Cyanamid (West Paterson, N.J.) as CYASTAT SN and 609, respectively. Preferred antistatic agents include the addition products of perfluoroalkylsulfonyl fluoride, e.g., FX-8 (manufactured by Minnesota Mining and Manufacturing, St. Paul, Minn.), and polyether diamines, e.g. JEFFAMINE ED-900 (available from Texaco), prepared according to the method described in U.S. Pat. No. 5,217,767 (Gutman et al.). If an antistatic agent is desired, it is used in an amount effective to reduce the static charge buildup. Preferably, if an antistatic agent is desired, it is used in an amount of less than about 4 wt-%, based on the total weight of the solids content of the coating composition. It should be understood that combinations of antistatic agents can also be used.

The components of the coating composition of the present invention are combined with water, preferably deionized water as very hard water can cause the latex to coagulate. Upon suitable mixing, the coating composition is applied to a substrate by any suitable coating means, e.g., curtain coating, spray coating, knife coating, bar coating, roll coating, and the like, and dried. The thickness of the image-receiving layer is preferably about 0.2–1.5 μm for imaging in thermal mass transfer printers or in xerographic copiers, and about 0.25–0.5 μm for imaging in thermal dye transfer printers.

The substrate can be any material, preferably a flexible material, more preferably a transparent material, and most preferably a flexible transparent material, to which an image-receiving layer can be adhered, and which can withstand the temperatures involved in thermal transfer processes. Flexibility is desired so that the receptor sheet can travel through conventional thermal transfer printers. The substrate can be smooth or rough, porous or nonporous, continuous or sheetlike, reflective, transparent, or opaque. It can be formed from a film-forming material, such as paper, polymeric film, and the like. Of these, it is preferably a transparent polymeric film for use as a transparency on an overhead projector. Examples of materials for such transparent substrates include, but are not limited to: polyesters such as polyethylene terephthalate; polysulfones; polycarbonates; polystyrenes; polyolefins such as polyethylene and polypropylene; polyimides; polyamides; polyvinyl chlorides; and cellulose esters. Polyethylene terephthalate (PET) film is preferred, at least because of its thermal and dimensional stability. The thickness of the substrate is generally about 25–150 μm, preferably about 75–100 μm. In general, thicker sheets are more preferred because of considerations regarding handling as well as heat dissipation during the printing process.

Adhesion of the image-receiving layer to the substrate is important to the performance of the receptor sheet. Although it is not preferred, adhesion of the image-receiving layer to the substrate can be enhanced by the use of a layer of an adhesion promoter, i.e., an adhesive or primer layer. Suitable adhesion promoters include, for example, polyvinylidene chloride. For polyester substrates, polyvinylidene chloride priming is preferred. Such a primer layer also can enhance the scratch resistance of the receptor sheet.

During imaging on either a printer or copier, the receptor sheet is fed through the machine. The feeding motion and the repetition of the imaging cycles tend to scratch the receptor sheet. Such scratches or abrasion marks can be visible when projected on a screen using an overhead projector, which is distracting and detracts from the professional appearance of a presentation. Improved scratch resistance of the image-receiving layer is therefore highly desirable, even though such marks do not render the receptor useless. In addition to improving the cohesive and adhesive properties of the image-receiving layer, the choice of latex polymer can also affect the scratch resistance of the layer. The preferred class of latex polymers also gives the receptors both improved scratch resistance and resistance to fingerprinting. Furthermore, the tack reducing additives described herein, e.g., the water-soluble low molecular weight compounds and the water-soluble carbodiimide, give the receptor sheets improved resistance to fingerprinting.

The receptor sheets of the present invention are useful in most commercial thermal printers and copiers, and may be produced in a variety of different embodiments. The specific formulations of the coating compositions of the present invention were developed specifically for the Tektronix Phaser 200i Printer, which superseded the Phaser II printer, manufactured by Tektronix (Wilsonville, Oreg.). For printers other than these, it is believed that minor modifications in the formulations would suffice to obtain good prints. Thus, the present compositions, although specific to the Phaser 200i printer, can be treated as a general formulation, requiring only minor modifications to provide satisfactory images on other printers.

In thermal transfer systems, the receptor sheets, e.g., transparencies, of the present invention are used in combination with a thermal transfer donor sheet or ribbon, i.e., a substrate on which is coated a donor layer. Typically, this layer includes a dye, or other colorant such as a pigment, in combination with a polymeric or resinous binder, although a binder may not always be present. That is, in certain situations the binder can be a part of the dye, as in polymeric dyes, for example. The binder typically binds the dye to the substram and also allows for transfer of the dyc to the receptor sheet upon the application of thermal energy. The binder in a thermal mass transfer donor sheet is typically a thermoplastic resin with a Tg below about 100° C. The binder in a thermal dye transfer donor sheet is typically a thermoplastic resin with a Tg of about 25°–180° C., preferably about 50°– 160° C. Examples of dye donor sheets are disclosed in U.S. Pat. Nos. 4,839,224 (Chou et al.); 4,847,237 (Vanderzanden); and 4,847,238 (Jongewaard et al.).

For some thermal printers, the receptor sheet can be produced with a flexible backing sheet attached to and having one surface in contact with the nonimaging surface (the imaging surface has the image-receiving layer coated thereon) of the receptor sheet to facilitate feeding. Such a composite is commonly referred to in the industry as an imaging manifold. The backing sheet can be made of paper or a synthetic polymeric sheet material, e.g., a plastic or synthetic paper. Examples of useful materials include, coated paper, glass line paper, laminated paper, oil proof paper, clay art paper, cassein art paper, simile paper, and the like, as well as films made of polyethylene, polypropylene, polystyrene, polycarbonate, polyvinyl chloride, polyamide, polysulfone, and the like. The backing sheet can also include blends or laminates of a plurality of such materials.

The backing sheet has an opposing surface that touches a second receptor sheet in a stack of such receptor sheets. Thus, such manifolds can be stack-fed through a printer, e.g., a thermal mass transfer printer, that has a multiple sheet feeding device. To further aid in feeding, a mixture of antistatic agent(s), e.g., quaternary ammonium salts, and a polymeric binder can be coated onto this opposing surface of the backing sheet of the imaging manifold. The backing sheet can be attached to the receptor sheet by conventional attaching means, e.g., an adhesive or tape, ultrasonic welding, and the like.

Generally, such imaging manifolds are useful in thermal mass transfer imaging systems, however, not all printers require such manifolds. For these printers, good feedability without a backing sheet, i.e., "tab," and lower multiple feeding tendencies can also be achieved if the side of the substrate opposite the image-receiving layer is coated, for example, with an antistatic agent or mixture of antistatic agents and a polymeric binder.

In a typical thermal transfer process, an image is transferred from the donor sheet to the receptor sheet by the application of thermal energy. The donor layer on the thermal transfer donor sheet or donor ribbon is placed in contact, i.e., a facing relationship, with the image-receiving layer on the thermal transfer receptor sheet and selectively heated according to a pattern of information signals, i.e., in an imagewise distributed manner. In this way, colorant (and in a mass transfer process, the binder as well) from the selectively heated regions of the donor sheet is transferred to the receptor sheet. A pattern is formed on the receptor sheet in a shape and density according to the intensity of heat applied to the donor sheet. The heating source can be an electrical resistive element, a laser such as an infrared laser diode, an infrared flash, a heated pen, or the like. The quality of the resulting image can be improved by readily adjusting the size of the heat source that is used to supply the thermal energy, the contact place of the donor sheet and the receptor sheet, and the amount of thermal energy applied.

Typically, the applied thermal energy is controlled to give light and dark gradation of the image to ensure continuous gradation of the image as in a photograph. Thus, the receptor sheet of the present invention can be utilized in the preparation of a photograph by printing, facsimile, or magnetic recording systems wherein various printers or thermal printing systems are used, in the preparation of a television picture or a cathode ray tube picture by operation of a computer, in the preparation of a graphic pattern or fixed image for suitable means such as a video camera, and in the preparation of progressive patterns from an original by an electronic scanner that is used in photomechanical processes of printing.

The invention has been described with reference to various specific and preferred embodiments and will be further described by reference to the following derailed examples. It is understood, however, that there are many extensions, variations, and modification on the basic theme of the present invention beyond that shown in the examples and derailed description, which are within the spirit and scope of the present invention.

Experimental Examples

The following compositions were prepared by diluting the AIRFLEX 430 latex emulsion to 26% solids from its original concentration of 52–56% as supplied. This was added to a mixing jar with a stirrer. A 5% aqueous solution of polyvinyl alcohol of 50,000 molecular weight, was prepared by suspending a premeasured quantity in water and heating the suspension with stirring until the solids dissolved. This was then added to the AIRFLEX latex emulsion with stirring. The FX-8 derivative of JEFFAMINE ED-900 (antistatic agent), which is a 100% active liquid, was mixed with an equal weight of isopropanol to obtain a clear, less viscous solution. This was then added to the mixture of AIRFLEX latex emulsion and polyvinyl alcohol with stirring. A sufficient amount of disodium salt of EDTA dihydrate was dissolved in water to obtain a 5% or 10% aqueous solution. This was then added to the mixture of AIRFLEX latex emulsion, polyvinyl alcohol, and antistatic agent with stirring. A sufficient amount of 3-ethyl-3-(dimethylamino) propyl carbodiimide HCl, which is a white hygroscopic powder, was dissolved in water to obtain a 5% solution. This was added to the mixture of AIRFLEX latex emulsion, polyvinyl alcohol, antistatic agent, and EDTA with stirring. The SMA-HDDA beads were suspended in a sufficient amount of water to form a 5% suspension, which was sonicated to disperse the beads. RHOPLEX B-88 PMMA latex was diluted to 20% solids. This particulate material was added to the mixture of AIRFLEX latex emulsion, polyvinyl alcohol, antistatic agent, EDTA, and carbodiimide. The deionized water was then added with stirring.

The coating formulation of Table 1 was coated on a polyester web substrate (available from Minnesota Mining and Manufacturing, St. Paul, Minn., under the tradename SCOTCHPAR brand biaxially oriented 3.88 mil polyethylene terephthalate film, product number 41-4400-0046-5), using a reverse gravure coater fitted with a Quad 75 roll at a web speed of about 30 feet minute, and dried for about 2 minutes at about 350° F. (177° C.). The coating formulation of Tables 2 and 3 were coated on a polyester web substrate using an air-knife coating procedure under a pressure of between 7.5 and 11 psi at a web speed of between 100 and 150 feet/minute, and dried for about 2–3 minutes at about 110° C. with cooling before winding.

TABLE 1

Latex Formulation With Poly(vinyl alcohol) and EDTA as Detackifiers

| INGREDIENT | Weight (g) | Weight % (Solids) |
|---|---|---|
| AIRFLEX 430 Emulsion (diluted to 26% solids from 56%) | 72 | 92.17 |
| Polyvinyl alcohol[1] (5% aq. solution) | 4 | 0.99 |
| FX-8 derivative of JEFFAMINE ED-900 (50% solution in isopropanol) | 1.6 | 3.94 |
| Ethylenediaminetetraacetic acid (disodium salt dihydrate[2] -- 10% aq. solution) | 3.5 | 1.72 |
| 3-Ethyl-3-(dimethylamino) propyl carbodiimide (hydrochloride salt -- 5% aq. solution) | 1.8 | 0.44 |
| Water (deionized) | 84 | — |
| SMA-HDDA beads (8 micron) (5% suspension in water) | 3 | 0.74 |

[1]PVA of molecular weight 50,000 was used. A number average molecular weight of about 50,000 is recommended, although the molecular weight dependence of the coating performance was perceived to be negligible.
[2]Other salt additives such as potassium hydrogen tartrate and glycine are also found to act as detackifiers.

TABLE 2

Latex Formulation With Detackifiers and Antiblocking Particles

| | Weight (g) | | Wt. of Solids | | % of Solids | |
|---|---|---|---|---|---|---|
| | | | | | Based on tot. | Based on tat. |
| Ingredients | 100 g batch | 1 gal batch | 100 g batch | 1 gal batch | wt of mixture | wt of solids |
| AIRFLEX 430 Emulsion (26% solids) [The latex at original conc. of 52% solids] | 72 | 2707 | 18.72 | 704 | 18.6 | 84.26 |
| Polyvinyl alcohol, MW 50,000 [5% aq. solution] | 4 | 150.4 | 0.2 | 7.52 | 0.2 | 0.9 |
| FX-8 derivative of JEFFAMINE ED-900 [50% in isopropanol] | 1.6 | 60.18 | 0.8 | 30.1 | 0.795 | 3.6 |
| EDTA Disodium salt dihydrate [5% aq. solution] | 3.5 | 131.6 | 0.175 | 6.58 | 0.174 | 0.787 |
| Ethyl-3(3-dimethylamino) propyl carbodiimide hydrochloric salt [5% aq. solution] | 0.9 | 33.84 | 0.045 | 1.692 | 0.045 | 0.202 |
| Water (deionized) | 5 | 188 | | | | |
| SMA-HDDA beads (8 micron) [5% aqueous suspension] | 3 | 112.8 | 0.15 | 5.64 | 0.15 | 0.675 |
| RHOPLEX B-88 Latex [20% solids, i.e., particles] [PMMA with —COOH] | 10.62 | 399.5 | 2.12 | 79.9 | 2.11 | 9.56 |

TABLE 3

Latex Formulation With Detackifiers and Antiblocking Particles

| Ingredients | Weight (g) 150 g batch | Weight (g) 1 gal batch | Wt. of Solids 150 g batch | Wt. of Solids 1 gal batch | % of Solids Based on tot. wt of mixture | % of Solids Based on tot. wt of solids |
|---|---|---|---|---|---|---|
| AIRFLEX 430 Emulsion (26% solids) [The latex at original conc. of 52% solids] | 72 | 1805 | 18.72 | 469 | 12.4 | 92 |
| Polyvinyl alcohol, MW 50,000 [5% aq. solution] | 4 | 100.9 | 0.2 | 5.05 | 0.13 | 0.98 |
| FX-8 derivative of JEFFAMINE ED-900 [50% in isopropanol] | 1.6 | 40.11 | 0.8 | 20.06 | 0.53 | 3.93 |
| EDTA Disodium salt dihydrate [5% aq. solution] | 3.5 | 87.75 | 0.175 | 4.39 | 0.12 | 0.86 |
| Ethyl-3(3-dimethylamino) propyl carbodiimide hydrochloric salt [5% aq. solution] | 1.8 | 45.13 | 0.090 | 2.26 | 0.06 | 0.44 |
| Water (deionized) | 64 | 1605 | | | | |
| SMA-HDDA beads (8 micron) [5% aqueous suspension] | 3 | 75.22 | 0.15 | 3.76 | 0.10 | 0.74 |
| RHOPLEX B-88 Latex [20% solids] [PMMA with —COOH] | 1.06 | 26.6 | 0.21 | 5.32 | 0.14 | 1.04 |

Test Method

Tackiness Testing

No quantitative measurements on tack were made. The roll of film that had been coated on a reverse gravure coater was kept wound for 2 weeks under a tension of 0.5–1 psi. Coated rolls of polyester film based on the formulation shown in Table 1 could be unwound after 72 hours. The coated film had one or two small blister dots per square foot, but mostly clear. Rolls coated by the solutions listed in Tables 2 & 3, and stored for two weeks, yielded clear, spotless sheets on unwinding. These latter formulations contained small amounts of hydrolyzed PMMA particles, which prevented the formation of these occasional blistery spots. Conversely, coating formulations that did not contain the detackifiers of this invention produced coated sheets which either could not be unwound from the roll, or produced a significant number of blisters on unwinding.

Coating Formulations

The coating formulation described in Table 1, which contained AIRFLEX 430 vinyl chloride/vinyl acetate/ethylene emulsion, polyvinyl alcohol, ethylenediaminetetraacetic acid disodium salt, 3-ethyl-3-(dimethylamino)propyl carbodiimide, and the primary antiblocking material SMA-HDDA beads, coated well on PVDC-primed 0.004 inch thick polyester. The coated film could be unwound from the roll easily. The film was clear, with only 1–2 small spots per square foot of the coated film, caused by blistering. This shows that these additives almost completely eliminated the tack.

The formulation of AIRFLEX 430 ethylene/vinyl acetate/vinyl chloride terpolymer latex with polyvinyl alcohol, EDTA disodium salt, SMA-HDDA beads, and the water-soluble carbodiimide as detackifiers was further modified by the inclusion of the secondary antiblocking agent RHOPLEX B-88 (Rohm & Haas), a 0.13 micron particle size latex of partially hydrolyzed poly(methylmethacrylate). One formulation (Table 2) contained about 9.6% by weight of the PMMA particles. A higher concentration of the coating solution was required to blend this higher level of PMMA and at the same time maintain the print quality. The Tg of the PMMA particles is about 90° C. Any compatible blend of such a polymer will be expected to have a higher Tg, and therefore be less tacky. However, in the coating solution containing about 1% of those PMMA particles, their effect on the glass transition temperature of the blend was negligible, yet the tack was reduced.

While this invention has been described in connection with specific embodiments, it should be understood that it is capable of further modification. The claims herein are intended to cover those variations which one of skill in the art would recognize as the chemical equivalent of what has been described herein. Thus, various omissions, modifications, and changes to the principles described herein may be made by one skilled in the art without departing from the true scope and spirit of the invention which is indicated by the following claims.

What is claimed is:

1. An image receptor sheet comprising a substrate on which is coated an image-receiving layer; said image-receiving layer formed from a water-based coating composition comprising:

(a) a major amount of a latex polymer having a Tg of no greater than about 30° C.;

(b) a minor amount of a water-soluble low molecular weight compound or salt having reactive functional groups; and (c) a minor amount of a water-soluble carbodiimide; wherein the latex polymer comprises a terpolymer of ethylene, vinyl acetate, and vinyl chloride monomers having about 1–5 wt-% polar groups.

2. The image receptor sheet of claim 1 wherein the water-soluble low molecular weight compound or salt contains reactive functional groups selected from the group consisting of a hydroxyl group, a carboxyl group, an amino group, an amido group, and combinations thereof.

3. The image receptor sheet of claim 1 wherein the water-based coating composition further includes a water-soluble hydroxyl-containing polymer.

4. The image receptor sheet of claim 1 wherein the water-based coating composition further includes a particulate material.

5. The image receptor sheet of claim 4 wherein the particulate material comprises a combination of reactive and nonreactive particulate material.

6. An image receptor sheet comprising a substrate on which is coated an image-receiving layer; said image-receiving layer formed from a water-based coating composition comprising:

(a) a major amount of a latex polymer having a Tg of no greater than about 30° C.;

(b) a minor amount of a water-soluble low molecular weight compound or salt having reactive functional groups;

(c) a minor amount of a water-soluble carbodiimide;

(d) a water-soluble hydroxyl-containing polymer; and (e) particulate material comprising stearyl methacrylate/hexanedioldiacrylate particles.

7. The image receptor sheet of claim 6 wherein the particulate material further includes carboxy-substituted polymethylmethacrylate particles.

8. An image receptor sheet comprising a substrate on which is coated an image-receiving layer; said image-receiving layer formed from a water-based composition comprising:

(a) about 80–95 wt-% of a latex polymer having a Tg of no greater than about 30° C.;

(b) about 0.2–2 wt-% of a water-soluble low molecular weight compound or salt having reactive functional groups;

(c) about 0.1–1 wt-% of a water-soluble carbodiimide; and (d) particulate material comprising carboxy-substituted polymethylmethacrylate beads.

9. An image system comprising:

(a) a mass transfer donor element; and (b) a receptor sheet comprising a substrate on which is coated a mass transfer image-receiving layer; said mass transfer image-receiving layer formed from a water-based coating composition comprising:

(i) a major amount of a latex polymer having a Tg of no greater than about 30° C.;

(ii) a minor amount of a water-soluble low molecular weight compound or salt having reactive functional groups; and (iii) a minor amount of a water-soluble carbodiimide.

10. The image system of claim 9 wherein the water-based coating composition further includes a water-soluble hydroxyl-containing polymer.

11. The image system of claim 9 wherein the water-based coating composition further includes a particulate material.

12. The image system of claim 9 wherein the latex polymer is formed from ethylenically unsaturated monomers.

13. The image system of claim 9 wherein the water-based coating composition comprises:

(a) about 80–95 wt-% of a latex polymer having a Tg of no greater than about 30° C.;

(b) about 0.2–2 wt-% of a water-soluble low molecular weight compound or salt having reactive functional groups; and (c) about 0.1–1 wt-% of a water-soluble carbodiimide.

14. An image receptor sheet comprising a substrate on which is coated an image-receiving layer; said image-receiving layer formed from a water-based coating composition comprising:

(a) a major amount of a latex polymer having a Tg of no greater than about 30° C.;

(b) a minor amount of a water-soluble low molecular weight compound or salt having reactive functional groups;

(c) a minor amount of a water-soluble carbodiimide;

(d) a minor amount of a water-soluble hydroxyl-containing polymer; and (e) a combination of reactive and nonreactive particulate material.

15. The image receptor sheet of claim 14 wherein the latex polymer comprises about 1–5 wt-% polar groups.

16. The image receptor sheet of claim 14 wherein the latex polymer comprises a copolymer of ethylene and monomers selected from the group consisting of vinyl acetate, vinyl chloride, and acrylic monomers that contain —OH, —COOH, $—CONH_2$, $—NH_2$, $—COOCH_2CH_2OH$, $—SO_3H$, $—p—C_6H_4—SO_3H$, —pyridyl, $—CONR_2$, $—NR_2$, or $—NR_4^+$ (wherein R is a lower alkyl group, i.e., containing 1–3 carbon atoms) functionality.

17. The image receptor sheet of claim 14 wherein the water-soluble low molecular weight compound or salt contains reactive functional groups selected from the group consisting of a hydroxyl group, a carboxyl group, an amino group, an amido group, and combinations thereof.

18. The image receptor sheet of claim 17 wherein the water-soluble low molecular weight compound or salt comprises ethylenediaminetetraacetic acid disodium salt.

19. The image receptor sheet of claim 14 wherein the water-soluble hydroxyl-containing polymer comprises a polyvinyl alcohol.

20. The image receptor sheet of claim 14 wherein the reactive particulate material comprises carboxy-substituted polymethylmethacrylate particles.

21. The image receptor sheet of claim 20 wherein the nonreactive particulate material comprises stearyl methacrylate/hexanedioldiacrylate particles.

22. The image receptor sheet of claim 14 wherein the water-based coating composition comprises:

(a) about 80–95 wt-% of the latex polymer having a Tg of no greater than about 30° C.;

(b) about 0.2–2 wt-% of the water-soluble low molecular weight compound or salt having reactive functional groups; and (c) about 0.1–1 wt-% of the water-soluble carbodiimide.

23. The image receptor sheet of claim 14 wherein the substrate is a transparent polymeric sheet about 75–100 μm thick.

24. An imaging manifold comprising:

(a) a receptor sheet comprising a flexible substrate having an imaging surface and a nonimaging surface, wherein an image-receiving layer is coated on the imaging surface; said image-receiving layer formed from a water-based composition comprising:

(i) about 80–95 wt-% of a latex polymer having a Tg of no greater than about 30° C.;

(ii) about 0.2–2 wt-% of a water-soluble low molecular weight compound or salt having reactive functional groups;

(iii) about 0.1–1 wt-% of a water-soluble carbodiimide;

(iv) about 0.1–3 wt-% of a water-soluble hydroxyl-containing polymer; and (v) a combination of a reactive and a nonreactive particulate material; and (b) a flexible backing sheet attached to and having one surface in contact with the nonimaging surface of the receptor sheet.

25. The imaging manifold of claim 24 wherein:

(a) the latex polymer comprises a terpolymer of ethylene, vinyl acetate, and vinyl chloride monomers;

(b) the water-soluble low molecular weight compound or salt comprises ethylenediaminetetraacetic acid disodium salt; and (c) the water-soluble hydroxyl-containing polymer comprises a polyvinyl alcohol.

* * * * *